US006450733B1

(12) United States Patent
Krill et al.

(10) Patent No.: US 6,450,733 B1
(45) Date of Patent: Sep. 17, 2002

(54) MOBILE ANTI-FLOOD PROTECTION DEVICE

(76) Inventors: Hans-Joachim Krill, Mühlendorf 16, D-58809 Neuenrade (DE); Klaus Heringhaus, Erste Strasse 6, D-58809 Neuenrade (DE)

( * ) Notice: Subject to any disclaimer, the term of this patent is extended or adjusted under 35 U.S.C. 154(b) by 0 days.

(21) Appl. No.: 09/308,601

(22) PCT Filed: Oct. 23, 1997

(86) PCT No.: PCT/DE97/02454

§ 371 (c)(1),
(2), (4) Date: Jun. 8, 1999

(87) PCT Pub. No.: WO98/22659

PCT Pub. Date: May 28, 1998

(30) Foreign Application Priority Data

Nov. 20, 1996 (DE) ..... 296 20 193 U

(51) Int. Cl.[7] ..... E02B 7/02
(52) U.S. Cl. ..... 405/114; 405/111; 405/107
(58) Field of Search ..... 405/15, 16, 21, 405/107, 110, 111, 114, 115, 116

(56) References Cited

U.S. PATENT DOCUMENTS

| | | | | | |
|---|---|---|---|---|---|
| 2,202,662 | A | | 5/1940 | Knight | |
| 3,213,628 | A | | 10/1965 | Serota | |
| 3,342,033 | A | * | 9/1967 | Crouch et al. | 405/116 |
| 5,118,217 | A | | 6/1992 | Younes | |
| 5,125,767 | A | | 6/1992 | Dooleage | |
| 5,645,373 | A | * | 7/1997 | Jenkins | 405/114 |
| 5,857,806 | A | * | 1/1999 | Melin | 405/115 |
| 5,865,564 | A | * | 2/1999 | Miller et al. | 405/115 |
| 5,984,577 | A | * | 11/1999 | Strong | 405/114 |
| 5,993,113 | A | * | 11/1999 | Darling | 405/114 |
| 6,042,301 | A | * | 3/2000 | Sovran | 405/114 |

FOREIGN PATENT DOCUMENTS

| | | | | |
|---|---|---|---|---|
| BE | 641590 | | 12/1963 | |
| DE | 2602955 | * | 7/1977 | E02B/3/10 |
| DE | 3417533 | | 11/1985 | |
| DE | 3423190 | | 2/1986 | |
| DE | 8808124 | | 12/1988 | |
| DE | 3823586 | * | 1/1990 | E02B/3/10 |
| DE | 4100889 | | 7/1992 | |
| DE | 4417726 | | 11/1995 | |
| EP | 586364 | | 8/1963 | |
| EP | 0586356 | | 8/1993 | |
| EP | 0721028 | | 7/1997 | |
| GB | 2269618 | | 2/1994 | |
| WO | 90/00648 | * | 1/1990 | E02B/7/00 |

OTHER PUBLICATIONS

Van Driel "autoband model voor waterkering" Land & Water vol. 35, No. 5, May 1995, Amsterdam.
Kunstoff Berater Jan. 1973, Bd. 18.
IKZ installation . . . , H5/1967.

* cited by examiner

*Primary Examiner*—Robert E. Pezzuto
*Assistant Examiner*—Alexandra K. Pechhold
(74) *Attorney, Agent, or Firm*—Horst M. Kasper

(57) ABSTRACT

A mobile anti-flood protection device comprising flexible tubes (1) placed on top of each other with closed ends and at least one water connection. The ends of the tubes (1) are detachably fixed to holding devices (2). The holding devices are removably secured to a base plate (3*a*) which is fastened to a substructure (3) to be included in the ground.

21 Claims, 4 Drawing Sheets

RETAINER MOUNT

2

Cross-section III - III

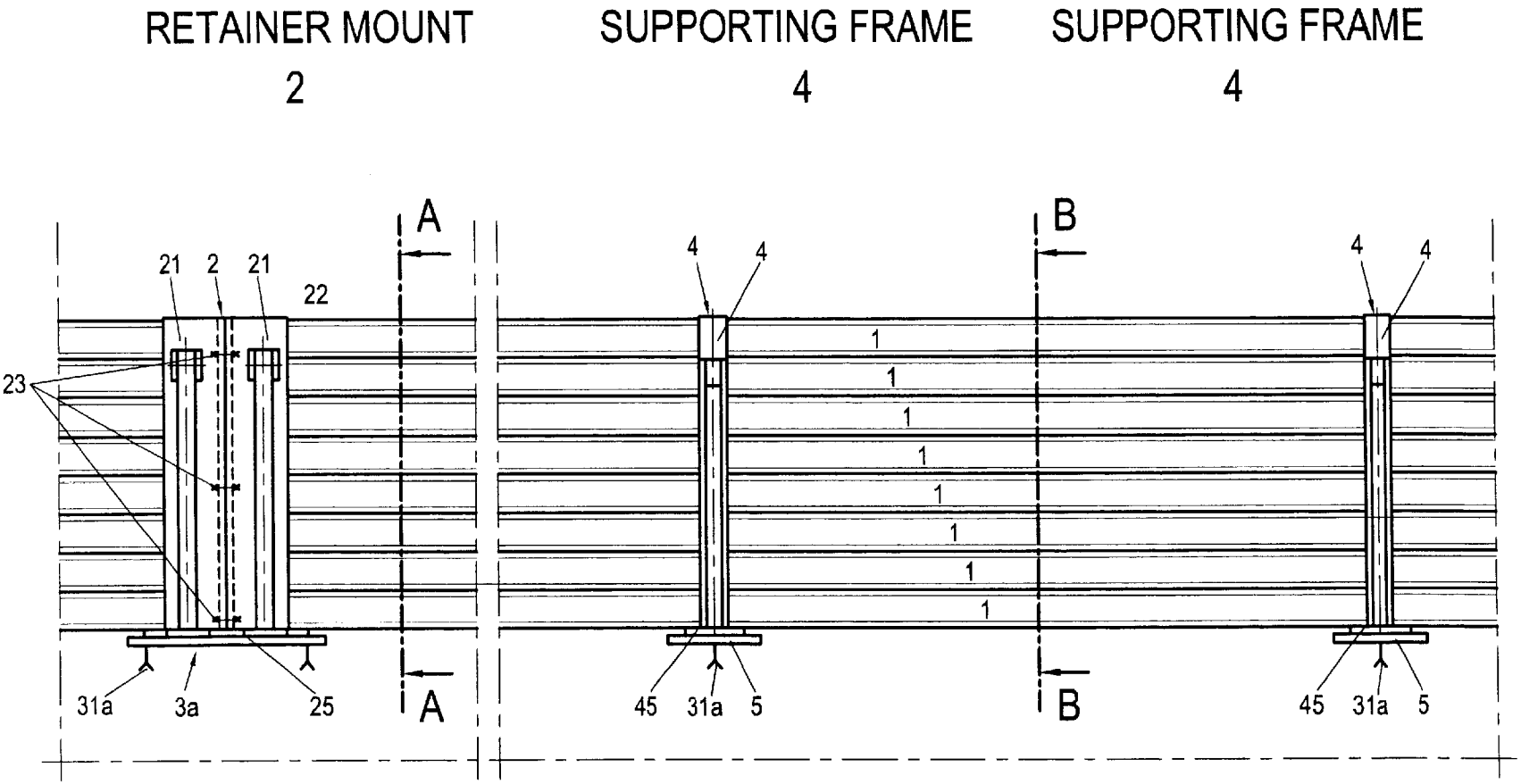
Fig.1. View - land side

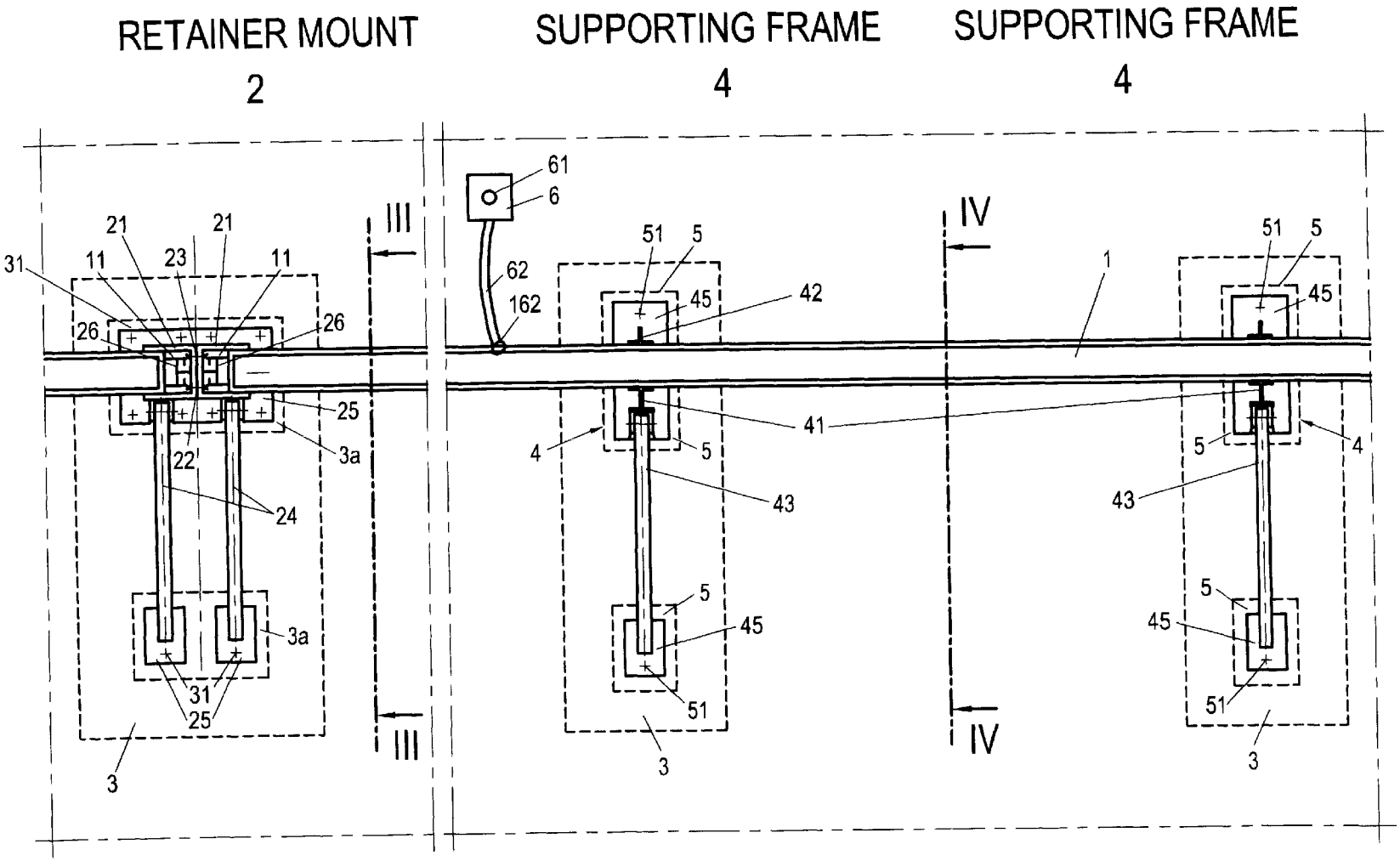
Fig.2. Top view

RETAINER MOUNT
2
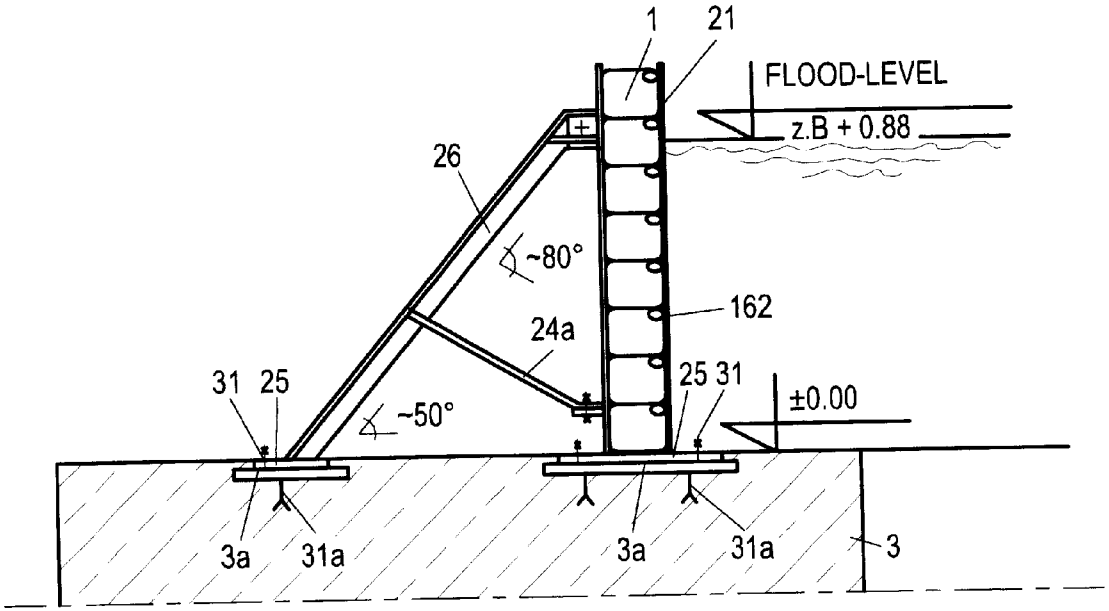
Fig.3. Cross-section III - III

SUPPORTING FRAME
4
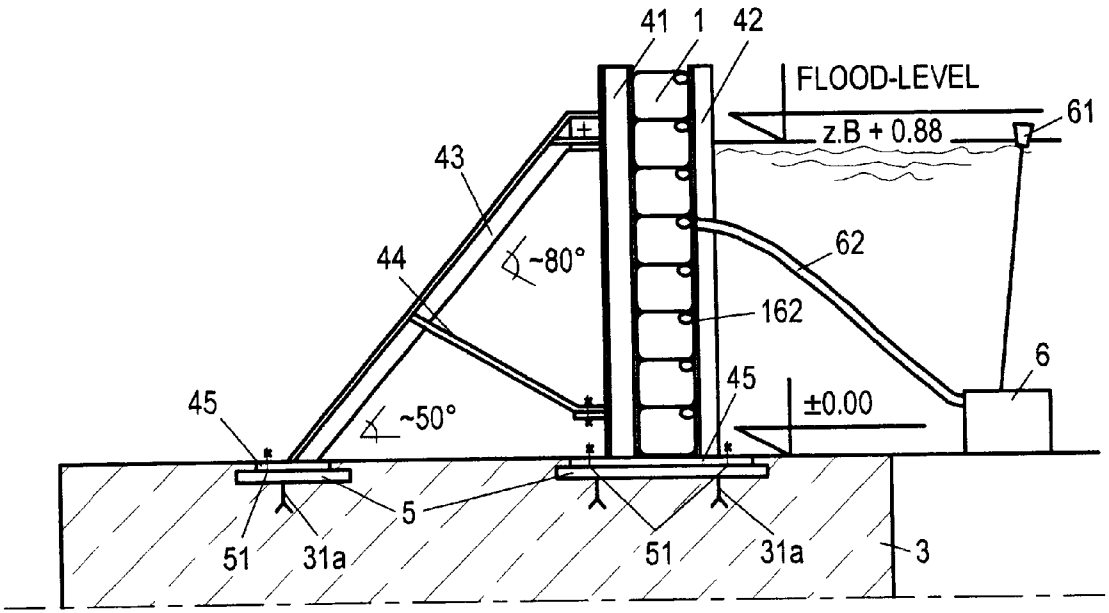
Fig.4. Cross-section IV - IV

MOBILE ANTI-FLOOD PROTECTION DEVICE

BACKGROUND OF THE INVENTION

Measures for protecting against high-water can be found at many water bodies. Usually these are fixedly installed constructive arrangements, such as for example dike constructions. In addition, mobile high-water protection constructions are known, which can be installed at locations selected for this purpose in case high-water is expected. Usually steel plates are employed, and for example passages in the dikes are hermetically sealed with the aid of the steel plates. These mobile high-water protection constructions are associated with the disadvantage, that they are difficult to transport and that their application field is limited to the passages in dikes.

In addition, there exists the following problem: on the one hand the danger of high water increases based on the warming up of the atmosphere of the earth, and the therefrom resulting increases in precipitation water as well as of the molten snow. On the other hand also wet lands, riversides, and meadows are impacted by the continuously advancing land use of the human being, wherein the wetlands, riversides, and meadows operate as catch basins in case high water occurs and thereby effect a deceleration of the increase of the high water level. Consequently, the wetlands, riversides, and meadows are frequently insufficient such that a surpassing of the high water level above the height level of the dikes is feared. The embankment construction therefore urgently requires an increase in height or renewal or, respectively, a longitudinal extension in order to prevent a surpassing of the dikes in case of high water. Such an increase in height of the dike is associated with substantial cost expenditures. In addition frequently the space available is insufficient to allow an increase in the embankment construction.

SUMMARY OF THE INVENTION

Here the invention will provide a remedy. It is an object of the invention to create a facility for protecting against high water, which facility makes possible a reinforcement of already present protective steps against high water in a simple manner and which is cost efficient. This object is accomplished according to the present invention by hoses closed at their ends and disposed on top of each other, which hoses exhibit at least one water connection and which hoses are disengageably attached at their ends in holder devices, which holder devices in turn are disengageably anchored on a floor plate, wherein the floor plate is attached at a substructure to be furnished in the ground.

A mobile device for protection against high water is created according to the present invention allowing to clearly reduce the expenditure in work time and material during transport as well as during the setting up and disassembly. In addition the simple mounting of the device according to the present invention leads to a noticeable lowering of costs. In addition a high water protection is possible in uneven terrain based on the adaptation of the hoses to the terrain. Furthermore there exists the possibility to generate radii in a nearly arbitrary way with the aid of the device such that the device can be installed without problems along the course of the water body.

According to a further embodiment of the invention, the hoses are disengageably connected to each other. The stability of the device is substantially increased by the connection of the hoses to each other. The disengageability of the connection of the hoses from each other furthermore enables a more simple transportation of the device to the respective place of application.

Advantageously, the hoses exhibit a substantially four cornered cross-section. The support face of the hoses amongst each other is increased based on this cross-section, whereby a problemfree sealing of the hoses is furnished. In addition, a more uniform support face is generated thereby.

According to an embodiment of the invention the water connections are formed in the shape of plug connectors. A simpler and quicker connection of water lines to the hoses is made possible with the aid of the plug connectors.

Preferably, in each case a check valve is disposed in the water connections, whereby an overfilling of the hoses with water and a possible bursting of the hoses resulting therefrom is prevented. In addition the filling volume can be limited to a predetermined volume by selecting an adjustable check valve.

According to a further embodiment of the invention water lines are connected to the water connections, wherein the water lines are connected to a pump. Preferably a float control is connected to the pump. It is thereby possible to fill the hoses with water depending on the level of the high water, such that not all hoses of the invention device have to be filled with water from the beginning. Thus the time expenditure during setting up of the device is reduced. In addition, based on the float control, an automatic filling of the hoses with water depending on the high water level in each case is made possible, whereby personnel expenditures are kept at a low level.

Finally, support frames are furnished between the holder or retainer mounting, where the support frames are disengageably attached on foot plates furnished in the ground. It is possible to protect very long sections with the aid of the hoses against high-water by furnishing supports along the device of the present invention.

An embodiment of the invention is illustrated in the drawing and is described in more detail in the following.

BRIEF DESCRIPTION OF THE DRAWINGS

There is shown:

FIG. 1 a view of the device from the side, relatively remote from the water course in a scale of 1:250;

FIG. 2 a top planar view onto the device illustrated in FIG. 1;

FIG. 3 a vertical sectional view through the device illustrated in FIG. 1 along section line A—A of FIG. 1;

FIG. 4 a vertical sectional view through the device illustrated in FIG. 1 along section line B—B of FIG. 1.

DETAILED DESCRIPTION OF THE INVENTION

A mobile device for protection against high water exhibits layer like superposed hoses 1. The height of the device and thus the number of hoses 1 disposed on top of each other is variable and depends on the high water level expected at the respective place of application. The mobile device selected as an embodiment exhibits 8 hoses with the hoses disposed on top of each other. The hoses 1 are disengageably attached with their ends in holder devices 2. The holder devices 2 are in each case also disengageably attached to floor plates 3*a*. The floor plates 3*a* are cast in concrete in a substructure 3 furnished in the ground. The device exhibits in longitudinal direction support frames 4 at a distance relative to each other, which support frames 4 are disengageably attached at floor plates 5. The floor plates 5 are cast in concrete in each case in a substructure 3.

The hoses 1 exhibit essentially a four cornered cross-section. The hoses 1 are produced of rubber, wherein one or several layers of fabrics can be incorporated in the rubber for increasing the stability of the hoses. The hoses 1 exhibit connectors at regular distances in the longitudinal direction, and the hoses 1 are connected to each other disengageably with the aid of the connectors. For example the connectors can be coupling closures for simple plug connectors. The hoses 1 having in each case at least one water connection 162, which water connection 162 is vulcanized into the hoses 1. The water connectors are formed in the shape of plug couplings and contain in each case a check valve. The hoses 1 exhibit eyes 11 at their closed ends, and the hoses are hanged with the eyes 11 into the support devices 2. The length of the hoses 1 as well as the dimensions of the cross-section of the hoses 1 are determined by the local situation as well as the static conditions based on the height level of the occurring high water. In addition the capability of transporting the hoses is to be considered for determining permissible dimensions for the hoses 1.

Each support device 2 comprises essentially a U-shaped steel profile 21. A ceiling profile 22 is disposed on the outside at the U-shaped steel profile 21. The U-shaped steel profile 21 exhibits bore holes on the side disposed remote to the hoses 1, wherein screw bolts 23 can be plugged through the bore holes in order to be able to firmly screw together U-profiles of sequential high water protection devices, such that the connection of the U-steel profiles with each other is water tight—FIGS. 1 and 2—. Steel support T-profiles 26 are welded into the U-steel profiles 21 for hanging in the hoses 1 with eyes 11. It is thereby possible to assure a safe high water protection also along extended distances, for example along the course of a river. T-steel braces 24 are disposed at the U-steel profiles 21 at the angle, which amounts to about 50 degrees in the embodiment shown. The T-steel braces 24 are screwed together with the U-steel profiles 21. Flat steel braces 24*a* are disposed at the braces 24 under an angle of about 80 degrees, wherein the flat steel braces 24*a* are also screwed together with the U-steel profiles 21. All steel profiles are galvanized with zinc and are thus not subject to rusting. The screws, nuts, bolts are produced from not rusting stainless steel. The braces 24 are furnished with foot plates 25 at their ends disposed remote to the U-steel profiles 21. The foot plates 25 are screwed together with the floor plates 3*a*.

The substructure 3 for example is produced from steel reinforced concrete. Steel anchors 31*a* are welded at the bottom side to the floor plates 3*a*, wherein the steel anchors 31 are cast into concrete in the substructure 3. The foot plates 25 of the support device 2 are attached on the floor plates 3*a* with screws 31. The floor plates 3*a* have steel plates screwed on with the screws 31 as covering in the non-assembled state of the device, which coverings exhibit the same dimensions as the foot plates 25.

The support device 4 exhibits double T-steel supports 41 on its side remote from the course of the water. The support device 4 exhibits T-steel supports 42 on the side of the hoses disposed opposite to the steel support 41, that is on the side of the hoses disposed toward the course of the water. The hoses 1 are thus held between the supports 41 and 42. The distance of the supports 41 and 42 from each other depends on the dimensions of the hoses 1 in the state filled with water. T-steel braces 43 are disposed at the support 41 under an angle of about 50 degrees in a way comparable to the steel braces 24 of the retainer mount 2. The steel braces 43 also exhibit the braces 44, which braces are attached at the steel supports 41 at the angle of about 80 degrees. The steel supports 41, 42 as well as the steel braces 43 are furnished with foot plates 45.

The mounting of the support devices 4 onto the floor plates 5 cast into the subconstruction 3 is performed in a way comparable to that of the holder devices 2. The foot plates 45 are attached here with the screws 51 onto the floor plates 5.

A pump 6 is disposed on this side toward the course of the water. The embodiment concerns an electrical water suction and electrical water pressure pump, which is connected the water connectors of the hoses 1 through feed hoses 62. The drawings show the single hose 62 leading to a hose 1 by way of example; in a practical situation each hose 1 is connected to the pump 6 through a feed hose 62. In addition, a connection of the hoses 1 to several pumps 6 is possible over feed hoses 62 upon application of several water connections 162 to in each case a single hose 1. The pump 6 includes a float control 61—FIG. 4—. The work of the pump 6 depending on the level of high water is performed with the aid of the float control 61. The pump 6 is to be equipped with a dirt filter for dirty water according to the use in a region of high water, as shown in the embodiment in order to prevent a plugging of the arm by sediments carried along in the high water. It is also possible to employ the pumps 6 not in the region of the high water, but to take the water from public dewatering systems.

When constructing the device according to the present invention, initially the support devices 2 are mounted on the floor plate 3 as well as support devices 4 are mounted on the sub construction 3. In the following thereto the hoses 1 are disposed layer by layer between the devices 2 and 4 in a non-filled state. This can for example be performed through hose roll up constructions and hose unroll constructions employed especially for this purpose. The hoses 1 are then connected to each other in longitudinal direction as well as are hanged into the holder devices 2 with eyes 11 disposed at the ends of the hoses 1. Upon occurrance of high water the hoses 1 are filled with the water by the pump 6 starting from the side disposed toward the floor (lowest layer). Upon employment of the controller 61 this filling is performed automatically. The automatic control is thereby to be performed such that always at least 1.5 hose layers disposed above the respective high water level are filled with water in order to oppose the buoyancy of the hoses 1 already in contact with the high water. The filling of the hoses 1 is performed by the pump 6 over the feed hoses 62 through the water connection 162 at the hoses 1. The degree of the filling of the hoses 1 amounts here to about 90 percent of the volume of the hoses 1, in order to effect thereby a widening of the support and additionally a more flexible laying of the hoses 1 amongst each other, which leads to a problem-free sealing against the high water. The degree of the filling is automatically controlled with the check valve integrated in the water connections 162. The sealing in the holder devices 2 is performed during the filling of the hoses 1 with water, when the hoses 1 press with their ends against the U-steel profiles 21.

In case of a falling level of high water, the filling water of the hoses 1 is pumped off in the same rhythm starting from the uppermost hose layer. Here again, always at least 1.5 layers of hose above the respective high water level remain filled with water. The filling and emptying of the hoses 1 is always performed depending on the respective high water level. If the water is pumped out of the hoses 1, then the hoses 1 lie flat on top of each other such that they assume the same position as after the rolling out during construction of the device. The hoses 1 can be rolled up and transported away in a simple way after disengagement of the hoses 1 from the support devices 2 as well as of the connections amongst each other. The demounting of the holder device 2 as well as of the support device 4 is performed in a sequence inverted relative to the sequence setting up and assembling the device.

The device according to the present invention can also be employed for high water protection of objects. It is necessary for this to drill force-matching dowels as screw-on anchors with a cover cap into the outer wall faces of a building at a predetermined distance and disposed above each other and next to each other. Steel support constructions formed as double T-steel profiles are screwed onto the wall screw dowels and thereupon hoses 1 constructed according to measurements depending on the static load to be expected based on the occurring high water are hanged into the profiles with eyes 11 in case of a danger of high water. The filling of the hoses 1 as well as their emptying are performed in the precedingly described way. The demounting and disassembly is performed in a sequence inverted relative to the sequence used for mounting and assembling. Advantageously a storage area for the device can be furnished in the object to be protected against high water.

Furthermore it is possible to employ the device of the present invention for securing loaded dike faces and for increasing the height of such dikes. The mounting and, respectively, demounting as well as the filling and the emptying of the device on the prepared subconstructions is performed in the above described way.

In addition there exists the possibility for the purpose of possibly required repair work at existing dike arrangements to hermetically seal these dike arrangements on three sides against water by pre-disposing of mobile wall elements of the same principle. Water filled hose elements are sunk up to the ground under consideration of water buoyancy in the hanging-in method on guide rails layer by layer at steel constructions, where the steel constructions are anchored and supported on the base of the water body. Thereafter the enclosed water can be pumped off. The demounting and disassembly of the hose arrangements is performed by pumping off the in each case upper layer and by pressing up to the water surface based on the water buoyancy. Then the demounting and disassembly of the steel holder construction is performed.

Furthermore the device according to the present invention is to be used in connection with caisson construction. For this purpose the device is constructed for example round, square or of oval shape. After the inserting of the steel holder construction with anchoring in the water body, closed and with water filled hose rings are sunk layer by layer up to the base of the water body. After the sealing has been performed, the water standing in the inner region of the caisson is pumped off such that most different activities can be performed in the dry region. The demounting of the caisson is performed by continuous pumping off of the water from the uppermost layers of hose, whereby the hoses are pressed higher based on the buoyancy of the water. In the following the demounting of the holder device and of the support device is performed in a sequence inverted relative to this sequence of mounting.

What is claimed is:

1. Apparatus for protection against high water, comprising hoses (1) closed at their ends, filled with water, and disposed on top of each other, which hoses exhibit at least one water connection (162) and which hoses are disengageably attached with their ends in holder devices (2), which holder devices (2) in turn are disengageably anchored on a floor plate (3*a*), wherein the floor plate (3*a*) is attached at a sub-construction (3) to be furnished at the ground, wherein support devices (4) are furnished between the holder devices (2), and wherein the support devices (4) are disengageably attached to second floor plates (5), and wherein the second floor plates (5) are disposed on the sub-construction (3) and wherein the holder devices (2) exhibit foot plates (25) at their ends disposed toward the floor plates (3*a*), wherein the foot plates (25) are screwed with screws (31) to the floor plates (3*a*).

2. Apparatus for protection against high water, comprising hoses (1) closed at their ends, filled with water, and disposed on top of each other, and which hoses are disengageably attached with their ends in holder devices (2), which holder devices (2) in turn are disengageably anchored on a floor plate (3*a*), wherein the floor plate (3*a*) is attached at a sub-construction (3) to be furnished at the ground, wherein support devices (4) are furnished between the holder devices (2), and wherein the support devices (4) are disengageably attached to second floor plates (5), and wherein the second floor plates (5) are disposed on the sub-construction (3), wherein the support devices (4) exhibit foot plates (45) at their ends disposed toward the second floor plates (5), wherein the foot plates (45) are screwed with screws (51) onto the second floor plates (5).

3. Apparatus for protection against high water, comprising hoses (1) closed at their ends, filled with water, and disposed on top of each other, and which hoses are disengageably attached with their ends in holder devices (2), which holder devices (2) in turn are disengageably anchored on a floor plate (3*a*), wherein the floor plate (3*a*) is attached at a sub-construction (3) to be furnished at the ground, wherein the holder devices (2) exhibit foot plates (25) at their ends disposed toward the floor plates (3*a*), wherein the foot plates (25) are screwed with screws (31) to the floor plates (3*a*).

4. The reuseable device for protection against high water according to claim 3 further comprising wherein sides of the water hoses are exposed to the ambient.

5. The reuseable device for protection against high water according to claim 3 further comprising wherein sides of the water hoses are uncovered.

6. The reuseable device for protection against high water according to claim 3 further comprising wherein an upper side of a first water hose follows a contour of a lower side of a second water hose.

7. The kit for protection against high water further comprising water hoses closed at their ends and disposed on top of each other;

a water connection furnished at the water hoses, holder devices for disengageably attaching the water hoses with ends of the water hoses to the holder devices;

a floor plate for disengageably anchoring the holder devices in turn on the floor plate;

a sub-construction to be furnished at the ground for attaching the floor plate to the sub-construction;

foot plates disposed at ends of the holder devices to be disposed toward the floor plates.

8. The kit for protection against high water according to claim 7 further comprising a water connection furnished at each one of the water hoses.

9. The kit for protection against high water according to claim 7 further comprising support devices capable of being disengageably attached to the floor plate for placement between the holder devices.

10. Apparatus for protection against high water, comprising hoses (1) closed at their ends, filled with water, and disposed on top of each other, the hoses having at least one water connection (162), and which hoses are disengageably attached with their ends in holder devices (2), which holder devices (2) in turn are disengageably anchored on a floor plate **(3*a*), wherein the floor plate (3*a*) is attached at a sub-construction (3) to be furnished at the ground, wherein support devices (4) are furnished between the holder devices (2), and wherein the support devices (4) are disengageably attached to second floor plates (5), and wherein the second floor plates (5) are disposed on the sub-construction (3)**.

11. Apparatus according to claim 10 wherein the hoses (1) are disengageably connected to each other.

12. Apparatus according to claim 10, wherein the hoses (1) exhibit an essentially four cornered cross-section.

13. Apparatus according to claim 10, wherein the at least one water connection is formed as a plug connection.

14. Apparatus according to claim 10, wherein a check valve is disposed in each case in the at least one water connection.

15. Apparatus according to claim 10, wherein a pump (6) is connected to the at least one water connection of the hoses (1) through feed hoses (62).

16. Apparatus according to claim 15, wherein the pump (6) exhibits a float control (61).

17. Apparatus according to claim 10, wherein the support devices (4) exhibit foot plates (45) at their ends disposed toward the second floor plates (5), wherein the foot plates (45) are screwed with the screws (51) onto the second floor plates (5).

18. The reuseable device for protection against high water according to claim 10 further comprising wherein sides of the water hoses are exposed to the ambient.

19. The reuseable device for protection against high water according to claim 10 further comprising wherein sides of the water hoses are uncovered.

20. The reuseable device for protection against high water according to claim 10 further comprising wherein an upper side of a water hose follows the contour of a lower side of the water hose.

21. The reusable device for protection against high water according to claim 10 wherein the water hoses form a single row of water hoses placed on top of the floor plate and on top of each other.

* * * * *